US007667666B2

(12) United States Patent
Chang et al.

(10) Patent No.: US 7,667,666 B2
(45) Date of Patent: Feb. 23, 2010

(54) WIDEBAND DIELECTRIC RESONATOR ANTENNA

(75) Inventors: Tze-Hsuan Chang, Taipei (TW); Jean-Fu Kiang, Taipei (TW)

(73) Assignee: National Taiwan University, Taipei (TW)

( * ) Notice: Subject to any disclaimer, the term of this patent is extended or adjusted under 35 U.S.C. 154(b) by 129 days.

(21) Appl. No.: 11/826,935

(22) Filed: Jul. 19, 2007

(65) Prior Publication Data

US 2008/0278378 A1 Nov. 13, 2008

(30) Foreign Application Priority Data

May 7, 2007 (TW) ..... 96116083 A

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 15/02*** | (2006.01) |
| ***H01Q 15/08*** | (2006.01) |
| ***H01Q 15/24*** | (2006.01) |
| ***H01Q 1/48*** | (2006.01) |

(52) U.S. Cl. ..... 343/911 R; 343/700 MS; 343/909; 343/846

(58) Field of Classification Search ..... 343/700 MS, 343/909, 911 L, 846, 785, 911 R
See application file for complete search history.

(56) References Cited

U.S. PATENT DOCUMENTS

| | | | | |
|---|---|---|---|---|
| 5,940,036 | A * | 8/1999 | Oliver et al. | 343/700 MS |
| 5,952,972 | A * | 9/1999 | Ittipiboon et al. | 343/700 MS |
| 6,292,141 | B1 * | 9/2001 | Lim | 343/700 MS |
| 6,313,797 | B1 * | 11/2001 | Kurita et al. | 343/700 MS |
| 6,323,824 | B1 * | 11/2001 | Heinrichs et al. | 343/846 |
| 6,621,381 | B1 * | 9/2003 | Kundu et al. | 333/202 |
| 6,833,816 | B2 * | 12/2004 | Hilgers | 343/700 MS |
| 7,196,663 | B2 * | 3/2007 | Bolzer et al. | 343/700 MS |
| 7,292,204 | B1 * | 11/2007 | Chang et al. | 343/909 |
| 7,443,363 | B2 * | 10/2008 | Ying | 343/911 R |
| 7,538,728 | B1 * | 5/2009 | Chang et al. | 343/700 MS |
| 2002/0154062 | A1 * | 10/2002 | Abe et al. | 343/700 MS |
| 2006/0232474 | A1 * | 10/2006 | Fox | 343/700 MS |
| 2008/0042903 | A1 * | 2/2008 | Cheng | 343/700 MS |

OTHER PUBLICATIONS

Half volume dielectric resonator antenna, IEE Electronics Letters, vol. 33, No. 23, pp. 1914-1916, Nov. 1997.*

Broadband Stacked Dielectric Resonator Antennas, Electronics Letters, vol. 25, No. 18, Aug. 31, 1989, 1232-1333.

(Continued)

*Primary Examiner*—Douglas W Owens
*Assistant Examiner*—Jennifer F Hu
(74) *Attorney, Agent, or Firm*—Muncy, Geissler, Olds & Lowe, PLLC

(57) ABSTRACT

An antenna comprises a substrate, a feed conductor, a ground layer, a resonator and a short-circuited element. The substrate comprises a first surface and a second surface. The feed conductor is formed on the first surface. The ground layer is formed on the second surface, comprising an aperture. The resonator is disposed on the ground layer, comprising a body and a notch, the notch is formed on a first side of the body, wherein the first side is perpendicular to the ground layer. The short-circuited element is disposed on the first side connecting the ground layer.

15 Claims, 5 Drawing Sheets

OTHER PUBLICATIONS

O'eefe, Steven G., et al., FDTD Simulation of Radiation Characteristics of Half-Volume HEM-and TE-Mode Dielectric Resonator Antennas, IEEE Transactions on Antennas and Propagation, vol. 50, No. 2, Feb. 2002, 175-179.

Buerkle, Amelia et al., Compact Slot and Dielectric Resonator Antenna With Dual-Resonance, Broadband Characteristics, IEEE Transactions on Antennas and Propagation, vol. 53, No. 3, Mar. 2005, 1020-1027.

A. Ittipiboon, A. Petosa et al., Perforated Dielectric Resonator Antennas, Electronics Letters, vol. 38, No. 24, Nov. 21, 2002, 1493-1495.

Chair, R. et al., Wideband Low Profile EYE Shaped Dielectric Resonator Antennas, 2005 IEEE, 582-585.

* cited by examiner

WIDEBAND DIELECTRIC RESONATOR ANTENNA

BACKGROUND OF THE INVENTION

1. Field of the Invention

The invention relates to an antenna, and more particularly to a wideband dielectric resonator antenna.

2. Description of the Related Art

The sizes of conventional dielectric resonator antennas can be reduced by using grounded metal plates at the cost of bandwidth reduction. Conventionally, resonators with different shapes (for example, resonators with a triangular and circular cross section) are stacked to increase bandwidth of dielectric resonator antennas. Or, resonators which transmit signals in different bands are incorporated into one dielectric resonator antenna to provide an increased bandwidth. However, conventional dielectric resonator antennas require a complex manufacturing process and increased cost, and size thereof is large, thus preventing utilization in minimized portable electronic devices.

BRIEF SUMMARY OF THE INVENTION

A detailed description is given in the following embodiments with reference to the accompanying drawings.

The embodiment relates to an antenna comprising a substrate, a feed conductor, a ground layer, a resonator and a short-circuited element. The substrate comprises a first surface and a second surface. The feed conductor is formed on the first surface. The ground layer is formed on the second surface, comprising an aperture. The resonator is disposed on the ground layer, comprising a body and a notch, the notch is formed on a first side of the body, wherein the first side is perpendicular to the ground layer. The short-circuited element is disposed on the first side connecting the ground layer.

The resonator is a dielectric resonator. The dielectric resonator comprises the notch. Therefore, when electric lines pass the notch to the short-circuited element, the electric field thereof is amplified for several times and can be radiated more efficiently. Hence, the quality factors of the resonator are reduced, and bandwidth of the antenna is increased. The antenna is minimized, is easily manufactured, reduces attrition rate and cost, has wide bandwidth of linear polarization, and can be mass produced by a manufacturing process (for example, a low temperature co-fired ceramic process).

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
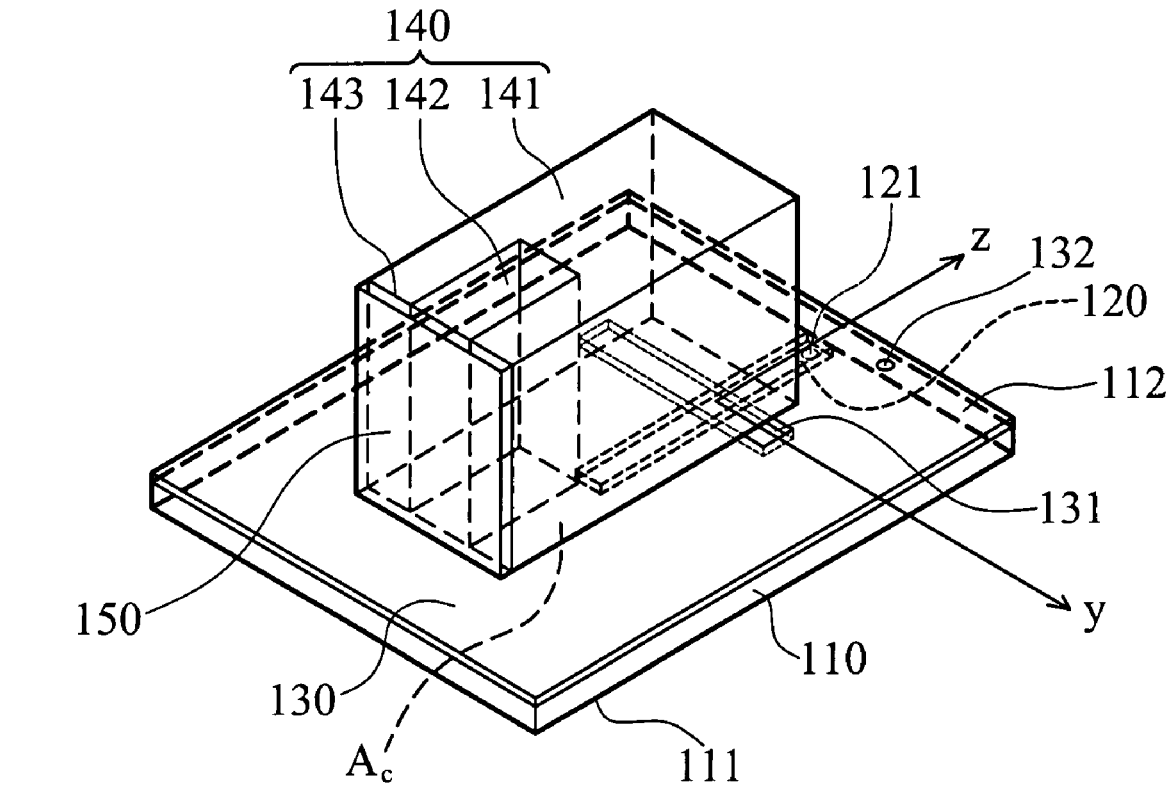
FIG. 1 shows an antenna of the invention.

FIG. 1 shows an antenna 100 of the invention, which is a notched wideband dielectric resonator antenna, comprising a substrate 110, a feed conductor 120, a ground layer 130, a resonator 140 and a short-circuited element 150. The substrate 110 comprises a first surface 111 and a second surface 112. The feed conductor 120 is formed on the first surface 111. The ground layer 130 is formed on the second surface 112. The ground layer 130 comprises an aperture 131. The resonator 140 is disposed on the ground layer 130 comprising a body 141 and a notch 142. The notch 142 is formed on a first side 143 of the body 141. The first side 143 is perpendicular to the ground layer 130. The short-circuited element 150 is disposed on the first side 143 connected to the ground layer 130.

The feed conductor 120 is longitudinal, extending on a first axis z. The aperture 131 is also longitudinal, extending on a second axis y. The first axis z is perpendicular to the second axis y. The feed conductor 120 extends over and passes the center of the aperture 131 (reference to FIG. 4*b*). The feed conductor 120 comprises a feed point 121 located on an end thereof electrically connected to a signal line. The ground layer 130 further comprises a ground point 132 electrically connected to a ground line.

The body 141 and the notch 142 are cubical. The first axis z is parallel to the major axis of the body 141. The body 141 overlaps the aperture 131. The body 141 defines a contact area $A_c$ on the ground layer 130. The first axis z passes the center of the contact area $A_c$, and extends perpendicular to the first side 143.

The resonator 140 is a dielectric resonator made of one of dielectric materials including low temperature co-fired ceramic and materials with high dielectric coefficients. The substrate 110 is made of one of dielectric materials including Teflon, glass fiber, aluminum oxide, ceramic material, FR4 and Duroid. The short-circuited element 150 is a metal sheet.

Figure 2:
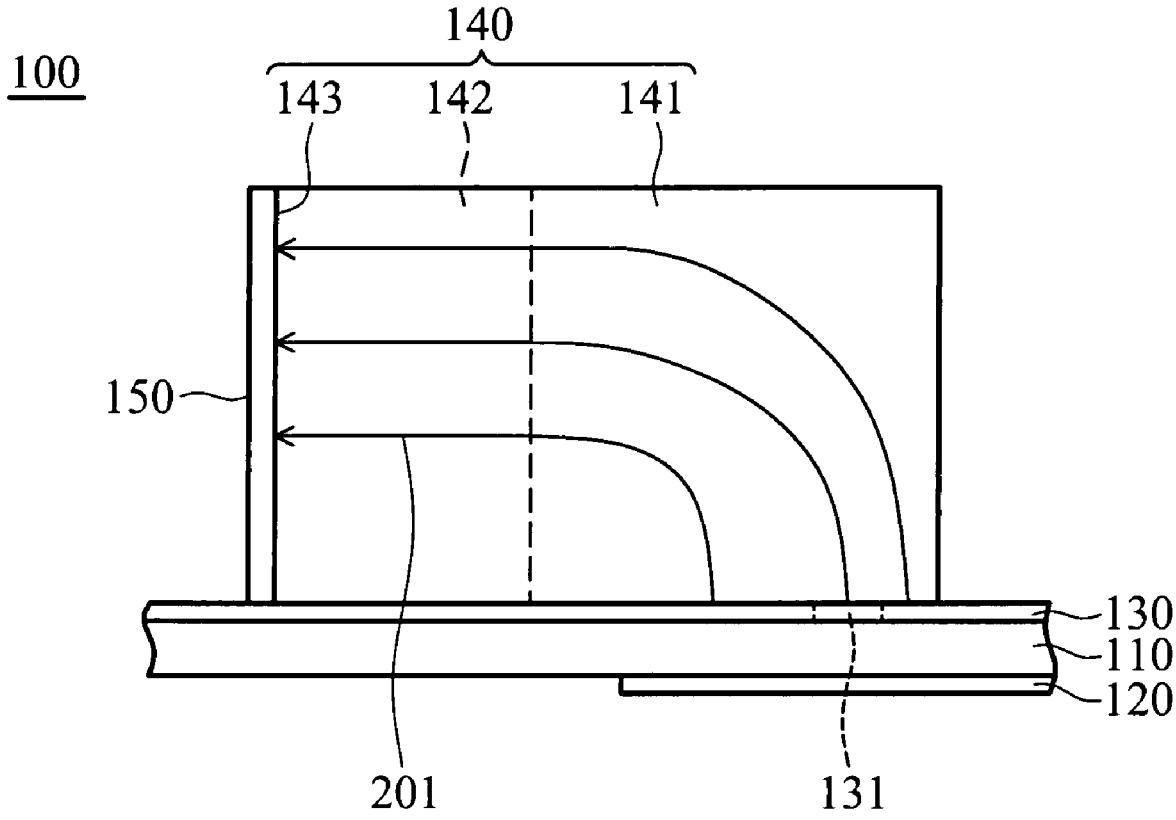
FIG. 2 shows an electric field of the antenna of the invention when the antenna transmits a wireless signal (5.12-5.85 GHz)
Figure 3:
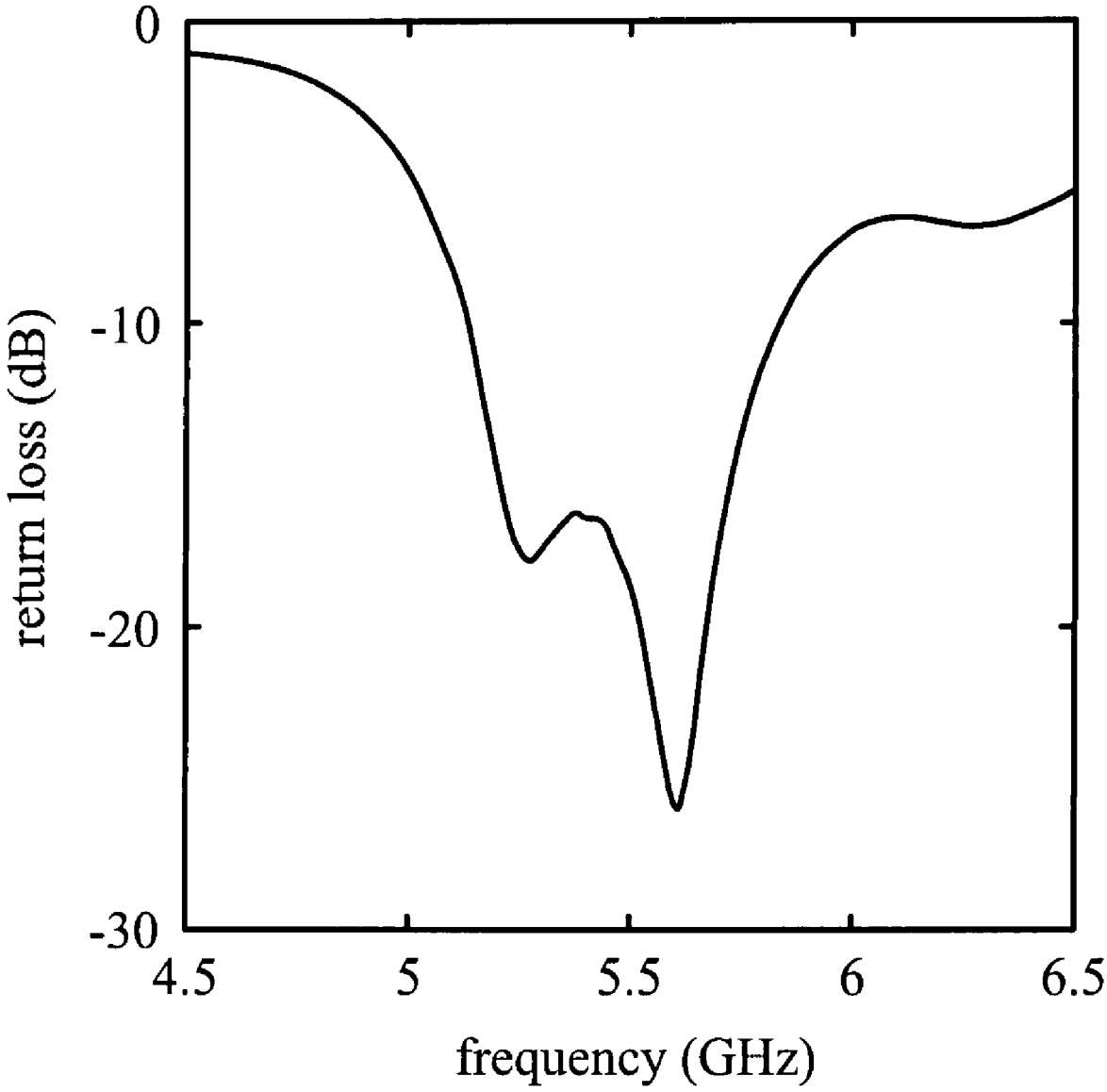
FIG. 3 shows the transmission of the antenna.

FIG. 2 shows an electric field distribution of the antenna 100 of the invention when the antenna 100 transmits a wireless signal (5.12-5.85 GHz). When the antenna 100 transmits the wireless signal, the wireless signal travels from the feed conductor 120, passing the aperture 131 and coupled to the resonator 140. The resonator 140 comprises the notch 142. Therefore, when electric lines 201 pass the notch 142 to the short-circuited element 150, the electric field thereof is amplified for several times. Quality factors of the resonator are reduced, and bandwidth of the antenna is increased. FIG. 3 shows the transmission of the antenna 100, which has a bandwidth covering 5.13 to 5.85 GHz, conforming to WLAN 802.11a standard. In FIG. 3, the bandwidth is defined as signals having return loss lower than −10 dB. The antenna is compact in size, is easily manufactured, reduces attrition rate and cost, has wide bandwidth, and can be mass produced by a manufacturing process (for example, a low temperature co-fired ceramic process).

Figure 4A:
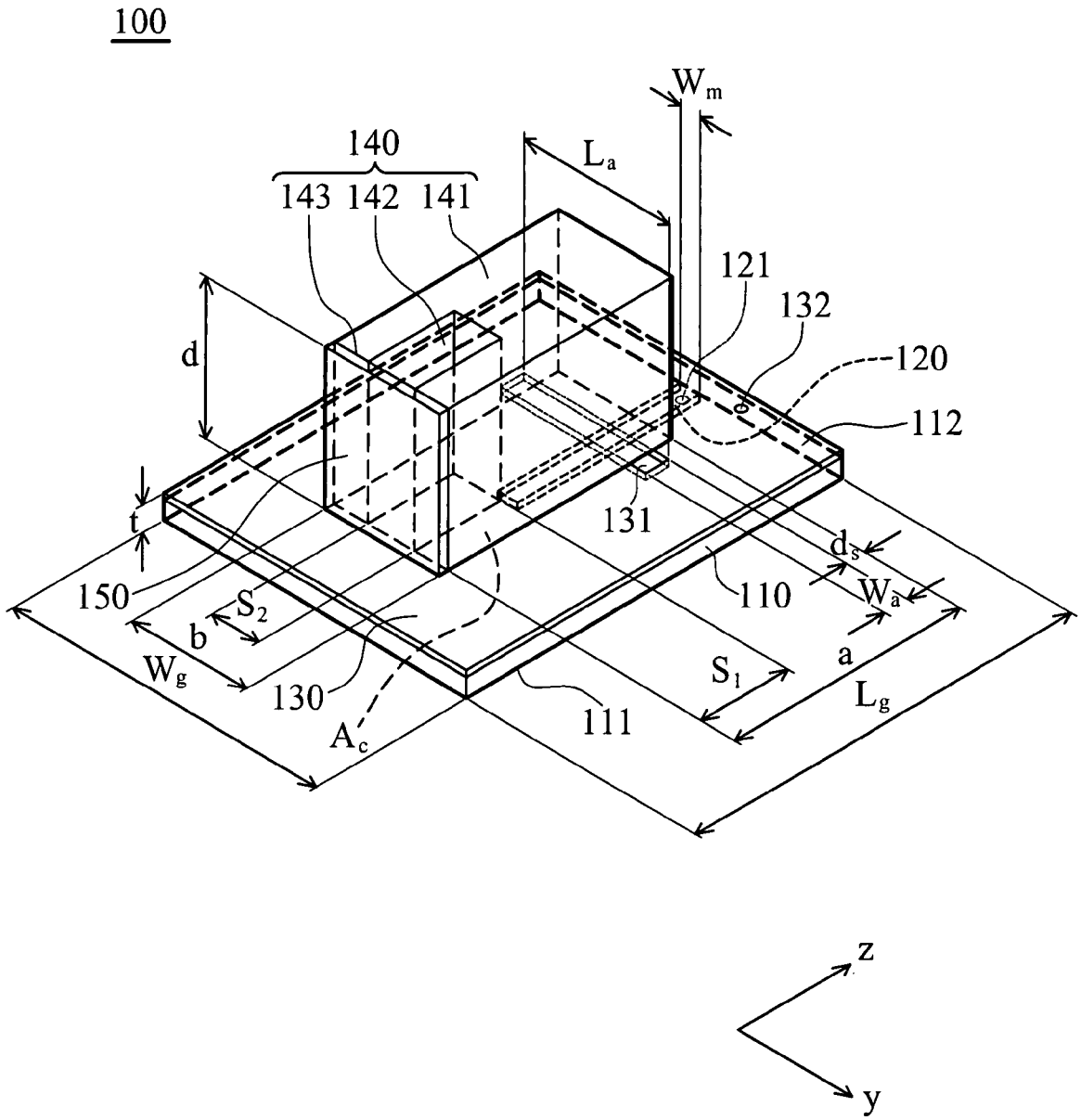
FIGS. 4*a* and 4*b* show dimensions of the elements of the antenna.
Figure 4B:
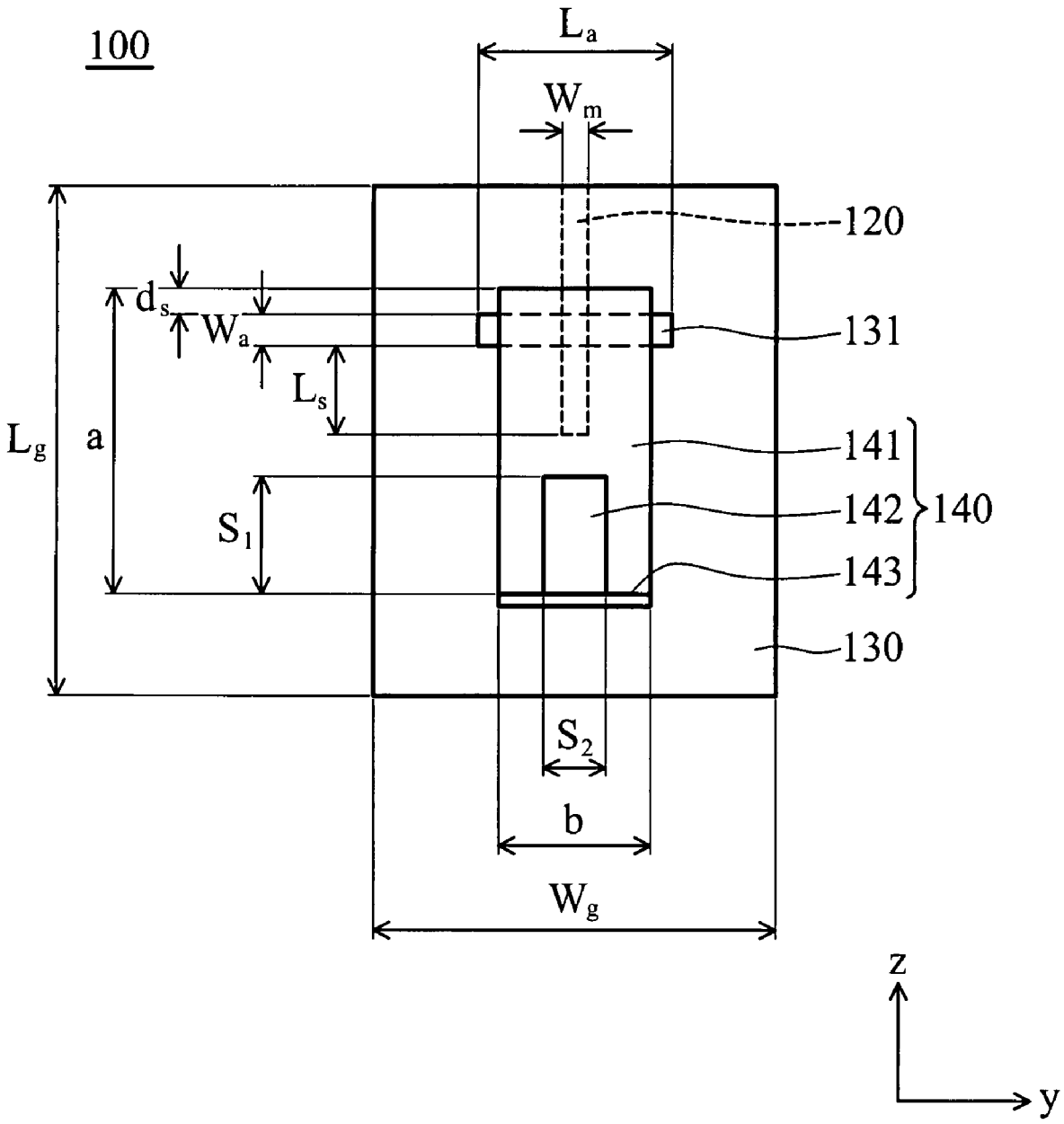

With reference to FIGS. 4*a* and 4*b*, the body 141 comprises length a, width b and height d. The notch 142 comprises length $s_1$ and width $s_2$. The substrate 110 and the ground layer 130 comprise length $L_g$ and width $W_g$. The feed conductor 120 comprises width $w_m$, and extends over the aperture 131 with length $L_s$. The aperture 131 comprises length $L_a$ and width $W_a$.

In the embodiment, the dimensions of the body 141 and the notch 142 are a=14.1 mm, b=10.4 mm, d=4.35 mm, $s_1$=4.4 mm, and $s_2$=5.6 mm. The dimension of the aperture 131 is $W_a$=1.5 mm, and $L_a$=7 mm. The dimensions of the substrate

110 and the ground layer 130 are $W_g=L_g=60$ mm. The thickness of the substrate 110 is t=0.6 mm. Dielectric coefficient of the substrate 110 is 4.4. Dielectric coefficient of the resonator 141 is 20. Edge of the resonator 140 is separated by a distance $d_s=1.5$ mm from the aperture 131. The feed conductor 120 extends over the aperture 131 with length $L_s=1.4$ mm.

In the embodiment, the dimension of the body (length a, width b and height d) can be modified to modulate the transmission frequency of the antenna. The dimension of the notch 142 (length $s_1$ and width $s_2$) can be modified to fine-tune the transmission frequency and increase a transmission bandwidth of the antenna. Additionally, input impedance between the resonator 140 and the feed conductor 120 can be matched by modifying the dimensions and the positions of the aperture 131 and the feed conductor 120.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a substrate, comprising a first surface and a second surface;

a feed conductor, formed on the first surface;

a ground layer, formed on the second surface, comprising an aperture;

a resonator, disposed on the ground layer, comprising a body and a notch, wherein the body has a first side, a second side, a third side and a fourth side, the first side and the second side are perpendicular to the ground layer, the third side and the fourth side are parallel to the ground layer, the fourth side contacts the ground layer, and the notch is carved off the body at the first side and extending from the third side to the fourth side; wherein the first side defines a planar surface; and a short-circuited element, disposed on the first side connecting the ground layer, extending along the planar surface.

2. The antenna as claimed in claim 1, wherein the resonator is a dielectric resonator.

3. The antenna as claimed in claim 2, wherein the dielectric resonator is made of the materials with dielectric constant larger than 10.

4. The antenna as claimed in claim 1, wherein the body is cubical.

5. The antenna as claimed in claim 1, wherein the notch is cubical.

6. The antenna as claimed in claim 1, wherein the short-circuited element is a metal sheet.

7. The antenna as claimed in claim 1, wherein the body overlaps the aperture.

8. The antenna as claimed in claim 1, wherein the feed conductor extends on a first axis, the aperture extends on a second axis, and the first axis is perpendicular to the second axis.

9. The antenna as claimed in claim 8, wherein the feed conductor extends over and passes a center of the aperture.

10. The antenna as claimed in claim 8, wherein the first axis is perpendicular to the first side.

11. The antenna as claimed in claim 8, wherein the body defines a contact area on the ground layer, and the first axis passes a center of the contact area.

12. The antenna as claimed in claim 8, wherein the first axis is parallel to a major axis of the body.

13. The antenna as claimed in claim 1, further comprising a feed point and a ground point, the feed point is located on an end of the feed conductor, and the ground point is located on the ground layer.

14. An antenna design method, comprising:

providing the antenna as claimed in claim 1;

modifying a dimension of the body to modulate a transmission frequency of the antenna; and modifying a dimension of the notch to fine-tune the transmission frequency and increase a transmission bandwidth thereof.

15. The antenna design method as claimed in claim 14, wherein when the antenna transmits a wireless signal, the wireless signal travels from the feed conductor, passing the aperture, the body and the notch to the short-circuited element.

* * * * *